US009795937B2

(12) United States Patent
Ries

(10) Patent No.: US 9,795,937 B2
(45) Date of Patent: Oct. 24, 2017

(54) FLUID HOLDING STRUCTURE FLUID CIRCULATING SYSTEM

(71) Applicant: John Ries, Elk Point, SD (US)

(72) Inventor: John Ries, Elk Point, SD (US)

( * ) Notice: Subject to any disclaimer, the term of this patent is extended or adjusted under 35 U.S.C. 154(b) by 761 days.

(21) Appl. No.: 14/220,353

(22) Filed: Mar. 20, 2014

(65) Prior Publication Data

US 2015/0165401 A1 Jun. 18, 2015

Related U.S. Application Data

(63) Continuation-in-part of application No. 14/133,244, filed on Dec. 18, 2013.

(51) Int. Cl.

| | |
|---|---|
| ***B01F 7/00*** | (2006.01) |
| ***B01F 15/00*** | (2006.01) |
| ***B01F 7/22*** | (2006.01) |

(52) U.S. Cl.

CPC ..... *B01F 7/22* (2013.01); *B01F 7/00733* (2013.01); *B01F 15/00662* (2013.01)

(58) Field of Classification Search

CPC .... B01F 7/00341; B01F 7/00733; B01F 7/22; B01F 15/00662

See application file for complete search history.

(56) References Cited

U.S. PATENT DOCUMENTS 3,797,809 A * 3/1974 Sydnor, Jr. ..... B01F 3/04773 261/120
3,856,272 A * 12/1974 Ravitts ..... B01F 3/04539 210/242.2
3,871,581 A * 3/1975 Dively ..... B01F 3/04773 239/16
3,998,389 A * 12/1976 Rose ..... B01D 47/06 239/214.21
4,014,526 A * 3/1977 Cramer, Jr. ..... B01F 7/00733 366/155.1
4,642,919 A 2/1987 Werner et al.
8,191,868 B2 6/2012 Tooley et al.
D673,178 S 12/2012 Tatic
8,517,700 B2 8/2013 Liberg
(Continued)

FOREIGN PATENT DOCUMENTS

| | | |
|---|---|---|
| DE | 20201300004 | 9/2013 |
| EP | 2006546 | 12/2008 |
| GB | 2462930 | 8/2009 |

(Continued)

*Primary Examiner* — Tony G Soohoo
*Assistant Examiner* — Anshu Bhatia

(57) ABSTRACT

A fluid holding structure fluid circulating system includes a fluid movement assembly with a propeller including a housing having a perimeter wall and a plurality of blades attached to an outer surface of the perimeter wall. A motor is mechanically coupled to the propeller and is positioned above the propeller. A buoy has buoyancy in fluid great enough to raise the fluid movement assembly adjacent to a surface of a fluid holding structure when the motor is turned off. The motor is mounted within the buoy and the propeller urges fluid upwardly toward the buoy when the motor is turned on to rotate the propeller. The propeller is completely exposed around its lateral periphery. A positioning cable is attached to the fluid movement assembly to facilitate movement thereof within the fluid holding structure.

22 Claims, 6 Drawing Sheets

(56) References Cited

U.S. PATENT DOCUMENTS

| | | | | |
|---|---|---|---|---|
| 2005/0061721 | A1* | 3/2005 | Tormaschy | B01F 3/04609 210/121 |
| 2012/0263606 | A1 | 10/2012 | Bouldin et al. | |

FOREIGN PATENT DOCUMENTS

| | | |
|---|---|---|
| WO | WO2006/001800 | 1/2006 |
| WO | WO2008060288 | 5/2008 |

* cited by examiner

FLUID HOLDING STRUCTURE FLUID CIRCULATING SYSTEM

I hereby claim the benefit under Title 35, United States Code, Section 120 of U.S. application Ser. No. 14/133,244 filed on Dec. 18, 2013.

BACKGROUND OF THE DISCLOSURE

Field of the Disclosure

The disclosure relates to fluid circulating devices and more particularly pertains to a new fluid circulating device for causing large circulation currents within a fluid holding structure without being hampered by material within the fluid.

SUMMARY OF THE DISCLOSURE

An embodiment of the disclosure meets the needs presented above by generally comprising a fluid movement assembly configured to urge fluid upwardly towards a surface of the fluid holding structure. The fluid movement assembly includes a propeller including a housing having a perimeter wall with an upper edge and a lower edge. A plurality of blades is attached to an outer surface of the perimeter wall. A motor is mechanically coupled to the propeller and is positioned above the propeller. A buoy has buoyancy in fluid great enough to raise the fluid movement assembly adjacent to the surface of the fluid holding structure when the motor is turned off. The motor is mounted in the buoy such that a bottom edge of the buoy is positioned adjacent to the motor. The propeller urges fluid upwardly toward the buoy when the motor is turned on to rotate the propeller. The propeller is completely exposed around its lateral periphery. A positioning cable is attached to the fluid movement assembly to facilitate movement of the fluid movement assembly within the fluid holding structure.

In another embodiment the disclosure meets the needs presented above by generally comprising a fluid movement assembly configured to urge fluid upwardly towards a surface of the fluid holding structure. The fluid movement assembly includes a propeller including a housing having a perimeter wall with an upper edge and a lower edge. A plurality of blades is attached to an outer surface of the perimeter wall. A motor is mechanically coupled to the propeller and is positioned above the propeller. A housing has a bottom edge and a motor is mounted in the housing adjacent to the bottom edge. The propeller urges fluid upwardly toward the housing when the motor is turned on to rotate the propeller. The propeller is completely exposed around its lateral periphery. A positioning cable is attached to the fluid movement assembly to facilitate movement of the fluid movement assembly within the fluid holding structure.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
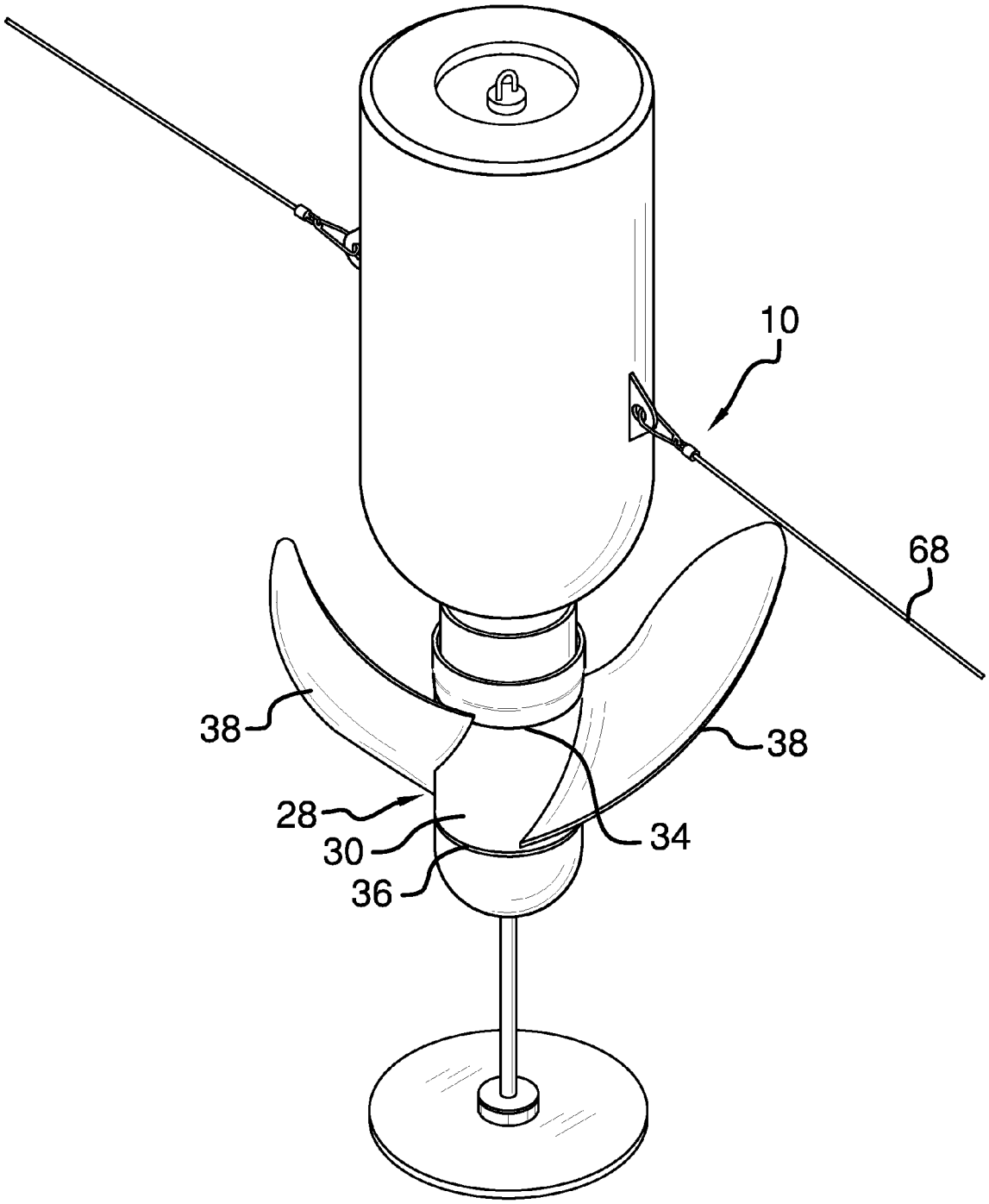
FIG. 1 is a top perspective view of a fluid holding structure fluid circulating system according to an embodiment of the disclosure.
Figure 2:
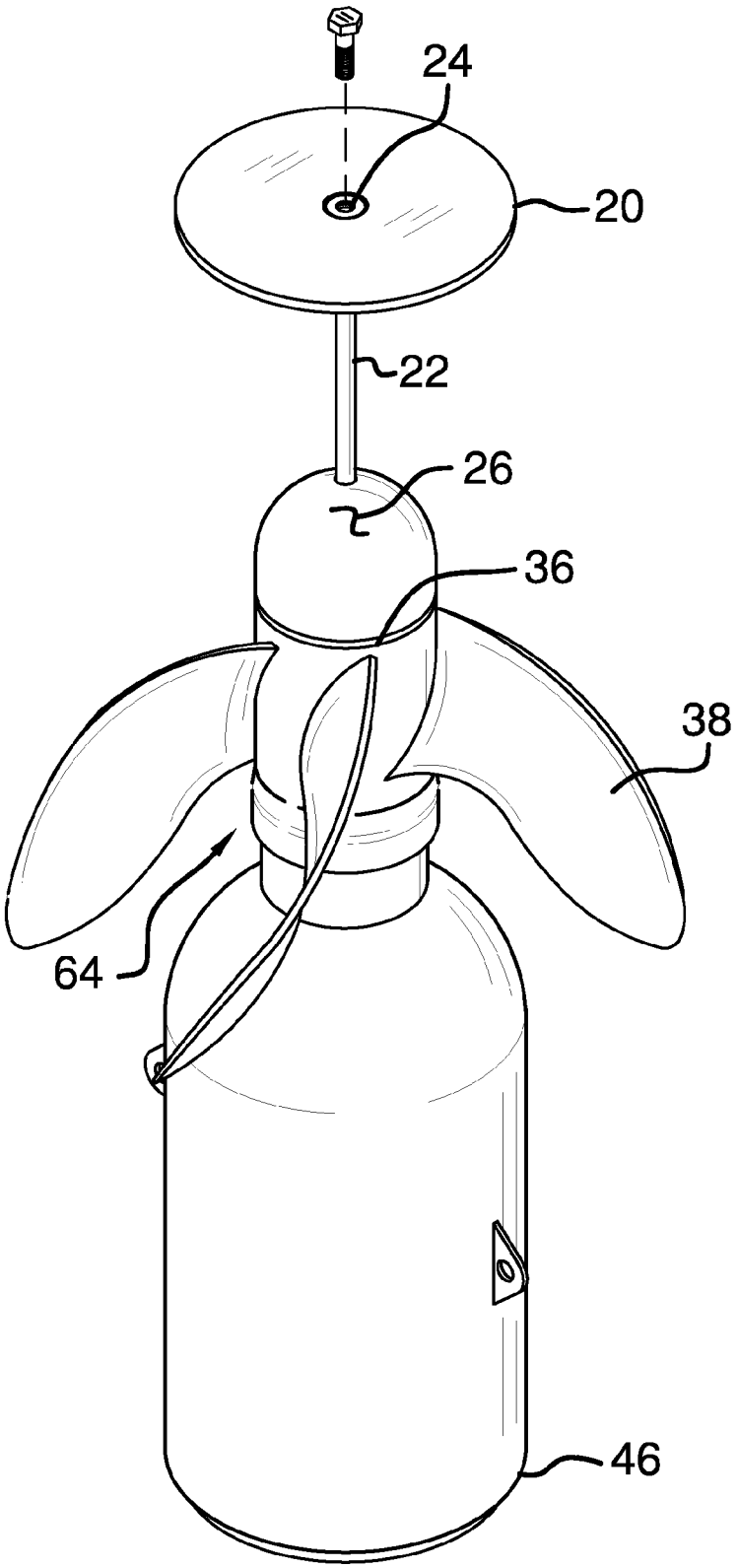
FIG. 2 is a bottom perspective view of an embodiment of the disclosure.
Figure 3:
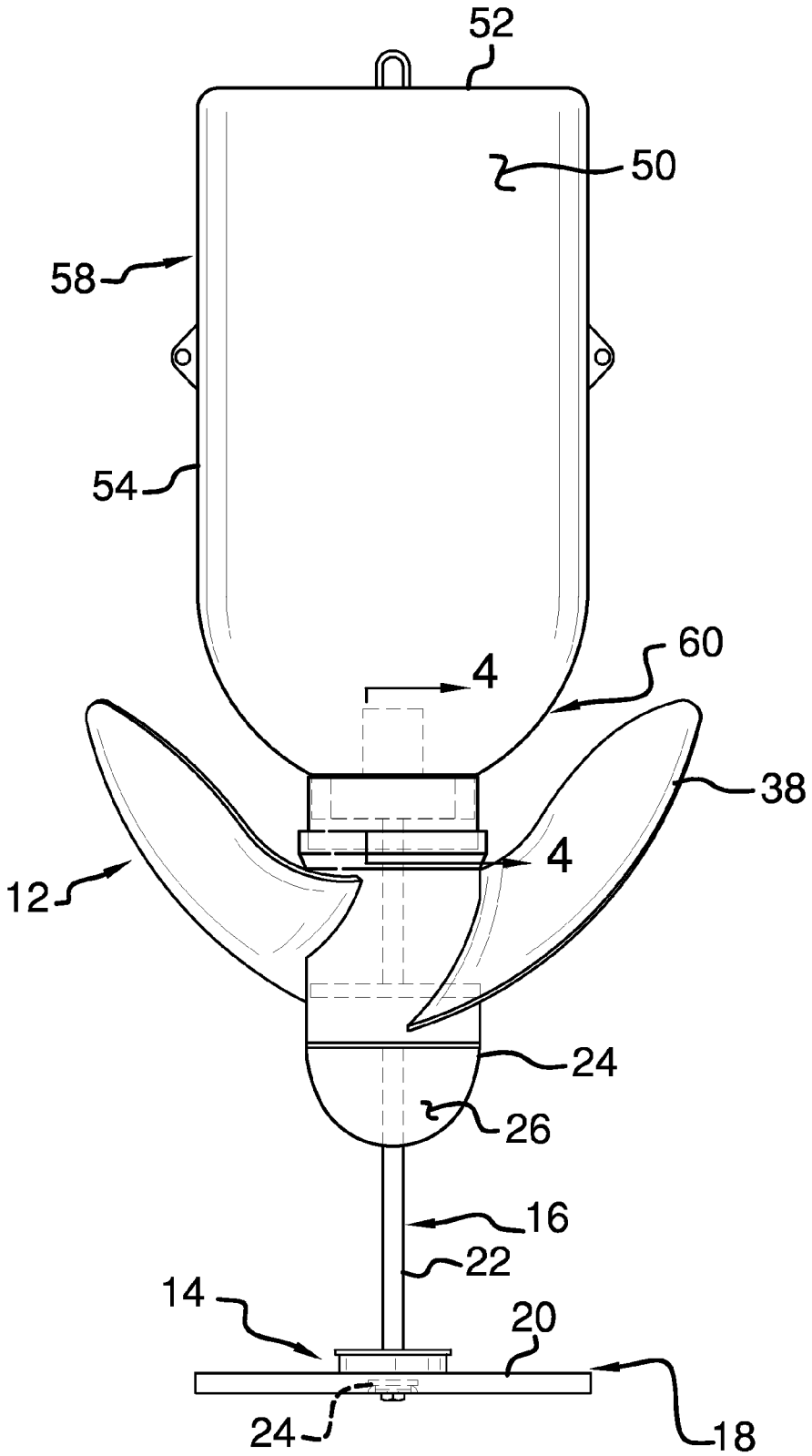
FIG. 3 is a side view of an embodiment of the disclosure.

With reference now to the drawings, and in particular to FIGS. 1 through 6 thereof, a new fluid circulating device embodying the principles and concepts of an embodiment of the disclosure and generally designated by the reference numeral 10 will be described.

As best illustrated in FIGS. 1 through 6, the fluid holding structure fluid circulating system 10 generally comprises a fluid movement assembly 12 configured to urge fluid upwardly towards a surface 71 of the fluid holding structure 70. The fluid holding structure 70 may comprise a pit, a pond, a tank or the like typically used for retaining fluids during the breaking down of organic materials. The purpose of moving fluid vertically through the fluid holding structure 70, generally, is to homogenize the fluid and further to prevent localized areas of oxygen deprived fluid which leads to anaerobic bacterial growth as is well known in the retention fluid holding structure arts. However, it should be understood that the system 10 may be used for general water circulation/oxygenation ponds such as, for instance, a fish farm and the fluid may substantially comprise water.

The fluid movement assembly 12 includes a stand 14 configured to be abutted against a floor 72 of a fluid holding structure 70. The stand 14 includes an upper section 16 and a lower section 18 wherein the lower section 18 includes a plate 20 which is generally horizontally oriented. The upper section 14 may comprise a post 22 oriented perpendicular to a plane of the plate 20. The post 22 and plate 20 may be rotationally coupled together with a bearing 24. A deflector 26 is attached to the stand 14 such that the stand 14 is positioned beneath the deflector 26. The deflector 26 has a convexly shaped outer surface 28 facing the stand 14 and is attached to the upper section 16 of the stand 14 opposite of the lower section 18. Generally, the shape and positioning of the deflector 26 are such that any material pulled upwardly through the fluid will be directed outwardly away from the center of the deflector 26.

A propeller 28 is attached to an upwardly facing side of the deflector 24. The propeller 28 includes a housing 30 that has a perimeter wall 32 with an upper edge 34 and a lower edge 36. The housing 30 therefore comprises a tube having an outer surface onto which a plurality of blades 38 is attached. A motor 40 is mechanically coupled to the propeller 28 and is positioned above the propeller 28. The motor 40 may particularly be an electric motor. The motor 40 may be in a fixed relationship with respect to the stand 14. This may be done in any number of conventional ways such as an attachment rod extending through an axle 42 coupling the motor 40 to the propeller 28 wherein the rod is attached to stand 14. However, it should be noted that typically the stand 14 would be decoupled from the propeller 28 such that the stand 14 does rotate with respect to the propeller 28. This may be accomplished by rotatably coupling the stand 14 to the deflector 24 or rotatably coupling the deflector 24 to the propeller 28. A gearbox 44 may be included to adjust the rotation speed of the propeller 28 relative to the rotational output speed of the motor 40.

A buoy 46 has buoyancy in fluid great enough to raise the fluid movement assembly 10 adjacent to the surface 71 of the fluid holding structure 70 when the motor 40 is turned off. The motor 40 is mounted in the buoy 46 such that a bottom edge 48 of the buoy 46 is positioned adjacent to the motor 40. The motor 40 may be fully positioned within the buoy 46 or the motor 40 may extend outwardly, and typically downwardly, from the buoy 46. The outer surface 50 of the buoy 46 includes an upper end 52 and a peripheral surface 54 extending between the upper end 52 and the bottom edge 48. The peripheral surface 54 further may include a lowermost portion 56 including the bottom edge 48, an uppermost portion 58 including the upper end 52 and a medial portion 60 positioned between the lowermost 56 and the uppermost 58 portions. The lowermost portion 56 has a cylindrical shape while the medial portion 60 may have a convexly arcuate shape.

The blades 38 are each shaped such that each blade 38 is contoured upwardly along a peripheral surface 54 of the buoy 46. By selecting such a shape, any material pulled upwardly through the fluid will be directed around and away from the buoy 46 and the connection between the buoy 46 and the propeller 28. The blades 38 each have a distal ends 62 with respect to the housing 30. A plane extending through each of the distal ends 62 is positioned above the bottom edge 48 of the buoy 46 to ensure that the material is sufficiently thrown away from the aforementioned engagement area of the propeller 28 and the buoy 46. It may be beneficial then that the blades 38 extend upwardly and are contoured along at least a portion of the medial portion 60. Moreover, the blades 38 may be angled outwardly in such a manner that the liquid is moved more outwardly than upwardly towards the motor to again move the liquid away from the buoy 46.

Figure 4:
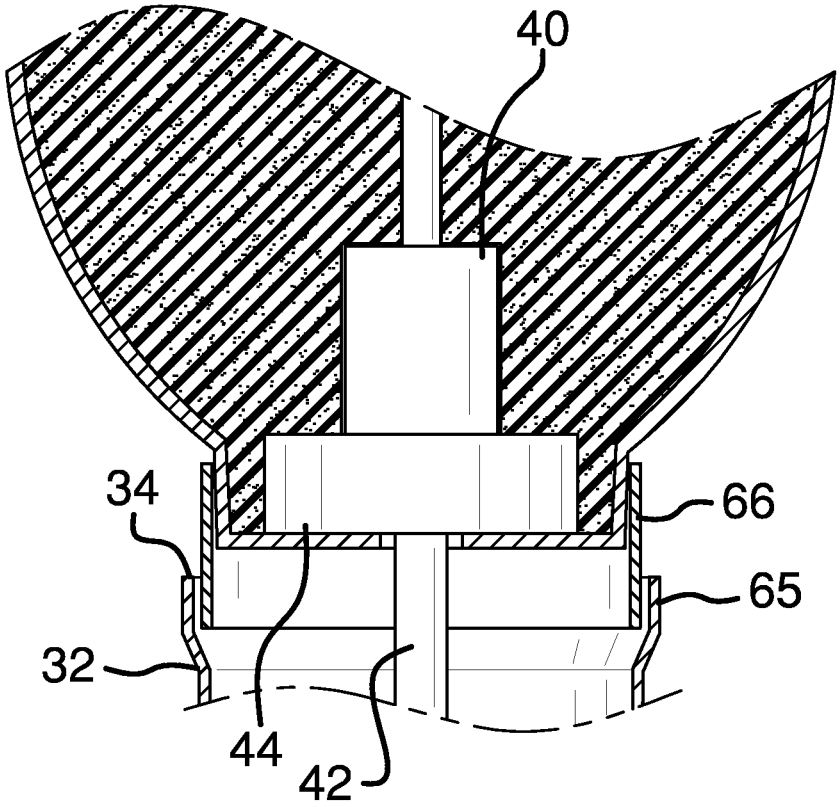
FIG. 4 is a cross-sectional view of an embodiment of the disclosure taken along line 4-4 of FIG. 3.
Figure 5:
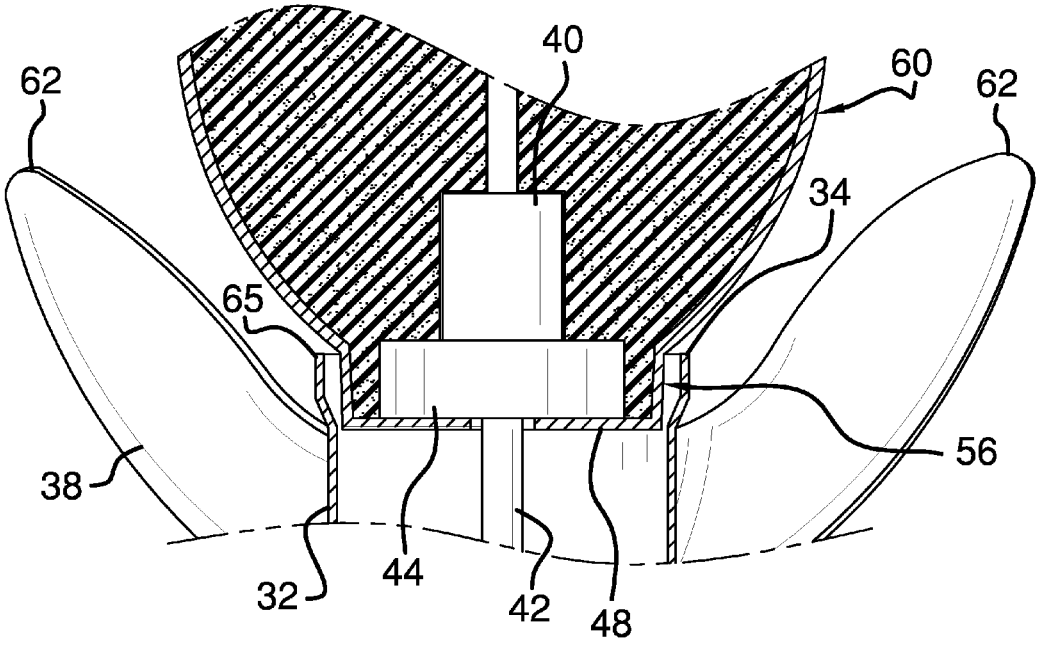
FIG. 5 is a cross-sectional view of an embodiment of the disclosure.

To further prevent material from interfering with motor 40 and propeller 28 operation, the bottom edge 48 of the buoy 46 may be covered by a shroud 64 that prevents material from flowing laterally between the bottom edge 48 and the propeller 28. As shown in FIG. 5, the shroud 64 may be formed by an upwardly extending flange 65 attached to the housing 30 of the propeller 28. The flange 65 receives the bottom edge 48 and may receive a substantial amount of the lowermost portion 56 of the buoy 46. Alternatively, as shown in FIG. 4, the shroud 64 may be formed by a sleeve 66 positioned within the housing 30, which still may include the flange 65, of the propeller 28 and extending upwardly therefrom. The bottom edge 48 is positioned within the sleeve 66. Again, the lowermost portion 56 may also be received by the sleeve 66.

The propeller 28 urges fluid upwardly toward the buoy 46 when the motor 40 is turned on to rotate the propeller 28. The propeller 28 is completely exposed around its lateral periphery. It is therefore outside of the stand and is not encased within a housing. Moreover, it should be understood that the entire assembly 12 and system 10 is submerged below the surface 71. This propeller 28 mounting position forces fluid upwardly without pulling fluid holding structure 70 material through a housing as is found in other circulation devices. This in turn prevents the propeller from being inundated with and hampered by plant material or other material which is often found in such fluid holding structures 70. For instance, animal fecal and birth materials as well as twine and other "stringy" elements are often found in retention ponds and can hamper efficiency of the propeller.

It should be noted that elements 10 and 12 differ in that element 12 includes the assembly as described above generally whereas element 10 includes element 12 and those attachments and usages thereto described below.

A positioning cable 68 is attached to the fluid movement assembly 12 to facilitate movement of the fluid movement assembly 12 within the fluid holding structure 70. To power the motor a power cord 69 is electrically coupled to the motor 40. The power cord 69 may simply be extended outwardly of the fluid holding structure 70 or attached to the positioning cable 68 to the buoy 46. The power cord 69 may then be conventionally electrically coupled to any electrical power source.

More generally, it should be understood that the buoy 46 may not be buoyant but may instead simply comprise a casing for the motor which is lifted, lowered and moved solely with one or more positioning cables 68. Moreover, while one particular shape of the buoy/casing 46 has been shown in the Figures, alternate configurations may be utilized. It is of particular importance that the blades 38 have a shape that extends upwardly from the housing 30 to partially encircle the motor 40 and/or the buoy/casing 46 to move water upwardly around the motor 40 to prevent any material from snagging on the blades 38 or along edges formed between the propeller 28 and items attached thereto and positioned above the propeller 28. Thus the blades 38, as shown, will contour upwardly to these elements as well as may be angled upwardly and outwardly from the propeller 28 housing 30. It is for this reason as well that the flange 65 has been added to ensure a smooth contouring on an outer surface of all elements above the propeller 28. The flange 65 will allow a smooth transfer from the propeller 28 to the buoy/casing 46.

Figure 6:
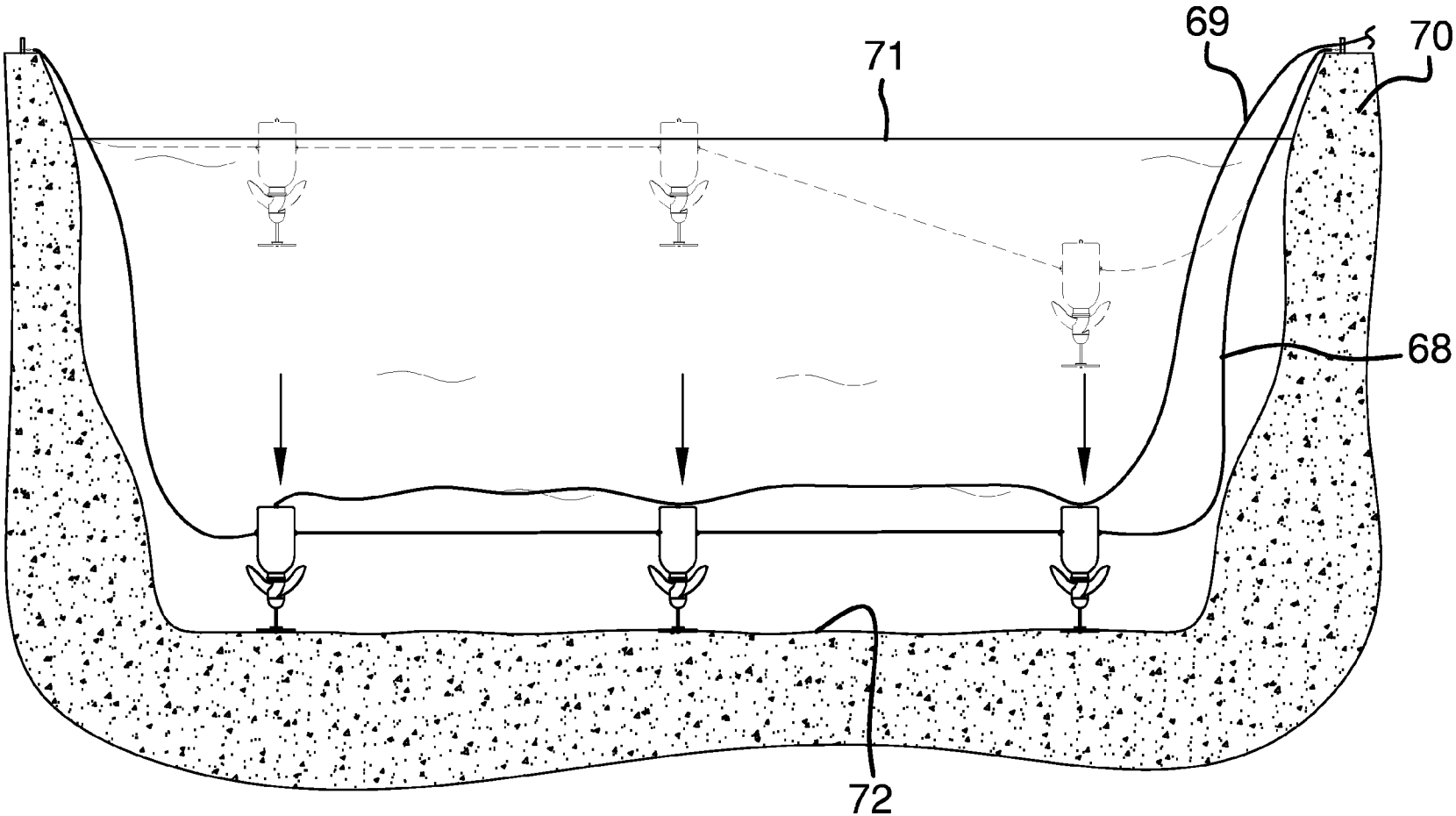
FIG. 6 is a side in-use view of an embodiment of the disclosure.

In use, one or more of the assemblies 12 is placed in a fluid holding structure 70. The buoy 46 will retain the assemblies 12 in a floating condition adjacent to the surface 71 of the fluid holding structure 70. As the motor 40 is turned on and power increased, the propeller 28 drives the assembly 12 downward toward the floor 72 of the fluid holding structure 70. Thus, utilizing less than full power of the motor 40 may cause the system 10 to float above the floor 72. The stand 14 may be constructed in shape and weight to retain the system 10 in a generally upright configuration as shown in FIG. 6. When the propeller 28 is turned on, its position and direction of rotation drives fluid upwardly towards the surface 71 to ensure homogenization of the fluid and surface oxygenation of the fluid to enhance preferable bacterial activity to consume waste materials in the fluid.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indebladeite article "a" does not exclude the possibility that more than one of the element is present, unless the context clearly requires that there be only one of the elements.

I claim:

1. A circulator system configured to be positioned within a fluid holding structure and to circulate fluid within the fluid holding structure, said system comprising:

a fluid movement assembly configured to urge fluid upwardly towards a surface of the fluid holding structure, said fluid movement assembly including:

a propeller including a housing having a perimeter wall with an upper edge and a lower edge, a plurality of blades being attached to an outer surface of said perimeter wall;

a motor being mechanically coupled to said propeller and being positioned above said propeller;

a buoy having a buoyancy in fluid great enough to raise said fluid movement assembly adjacent to the surface of the fluid holding structure when said motor is turned off, said motor being mounted in adjacent to a bottom edge of said buoy;

said propeller urging fluid upwardly toward said buoy when said motor is turned on to rotate said propeller, said propeller being completely exposed around its lateral periphery; and a positioning cable being attached to said fluid movement assembly to facilitate movement of said fluid movement assembly within the fluid holding structure.

2. The circulator system according to claim 1, wherein said fluid movement assembly further includes:

a stand configured to abut a floor of a fluid holding structure;

a deflector being attached to said stand such that said stand is positioned beneath said deflector, said deflector having a convexly shaped outer surface facing said stand, said deflector being attached to an upper section of said stand opposite of said lower section; and said propeller being attached to an upwardly facing side of said deflector.

3. The circulator system according to claim 2, wherein said stand includes said upper section and a lower section, said lower section including a plate being generally horizontally oriented, said upper section comprising a post oriented perpendicular to a plane of said plate.

4. The circulator system according to claim 1, wherein said bottom edge of said buoy is covered by a shroud to prevent material from flowing laterally between said bottom edge and said propeller.

5. The circulator system according to claim 4, wherein said shroud is formed by an upwardly extending flange attached to said housing of said propeller.

6. The circulator system according to claim 4, wherein said shroud is formed by a sleeve positioned within said housing of said propeller and extending upwardly therefrom, said bottom edge being positioned within said sleeve.

7. The circulator system according to claim 1, wherein each of said blades is shaped such that each blade is contoured upwardly along a peripheral surface of said buoy, said blades each having a distal ends with respect to said housing, a plane extending through each of said distal ends is positioned above said bottom edge of said buoy.

8. The circulator system according to claim 7, wherein said outer surface of said buoy including an upper end, said peripheral surface extending between said upper end and said bottom edge, said peripheral surface including a lowermost portion including said bottom edge, an uppermost portion including said upper end and a medial portion positioned between said lowermost and said uppermost portions, said medial portion having a convexly arcuate shape, wherein said blades are contoured along at least a portion of said medial portion.

9. The circulator system according to claim 4, wherein each of said blades is shaped such that each blade is contoured upwardly along a peripheral surface of said buoy, said blades each having a distal ends with respect to said housing, a plane extending through each of said distal ends is positioned above said bottom edge of said buoy.

10. The circulator system according to claim 9, wherein said outer surface of said buoy including an upper end, said peripheral surface extending between said upper end and said bottom edge, said peripheral surface including a lowermost portion including said bottom edge, an uppermost portion including said upper end and a medial portion positioned between said lowermost and said uppermost portions, said medial portion having a convexly arcuate shape, wherein said blades are contoured along at least a portion of said medial portion.

11. The circulator system according to claim 5, wherein each of said blades is shaped such that each blade is contoured upwardly along a peripheral surface of said buoy, said blades each having a distal ends with respect to said housing, a plane extending through each of said distal ends is positioned above said bottom edge of said buoy.

12. The circulator system according to claim 11, wherein said outer surface of said buoy including an upper end, said peripheral surface extending between said upper end and said bottom edge, said peripheral surface including a lowermost portion including said bottom edge, an uppermost portion including said upper end and a medial portion positioned between said lowermost and said uppermost portions, said medial portion having a convexly arcuate shape, wherein said blades are contoured along at least a portion of said medial portion.

13. A circulator system configured to be positioned within a fluid holding structure and to circulate fluid within the fluid holding structure, said system comprising:

a fluid movement assembly configured to urge fluid upwardly towards a surface of the fluid holding structure, said fluid movement assembly including:

a stand configured to abut a floor of a fluid holding structure, said stand including an upper section and a lower section, said lower section including a plate being generally horizontally oriented, said upper section comprising a post oriented perpendicular to a plane of said plate;

a deflector being attached to said stand such that said stand is positioned beneath said deflector, said deflector having a convexly shaped outer surface facing said stand, said deflector being attached to said upper section of said stand opposite of said lower section;

a propeller being attached to an upwardly facing side of said deflector, said propeller including a housing having a perimeter wall with an upper edge and a lower edge, a plurality of blades being attached to an outer surface of said perimeter wall;

a motor being mechanically coupled to said propeller and being positioned above said propeller;

a buoy having a buoyancy in fluid great enough to raise said fluid movement assembly adjacent to the surface of the fluid holding structure when said motor is turned off, said motor being mounted with said buoy such that a bottom edge of said buoy is positioned adjacent said motor;

said blades each being shaped such that each blade is contoured upwardly along a peripheral surface of said buoy, said blades each having a distal ends with respect to said housing, a plane extending through each of said distal ends is positioned above said bottom edge of said buoy;

said outer surface of said buoy including an upper end, said peripheral surface extending between said upper end and said bottom edge, said peripheral surface including a lowermost portion including said bottom edge, an uppermost portion including said upper end and a medial portion positioned between said lowermost and said uppermost portions, said lowermost portion having a cylindrical shape, said medial portion having a convexly arcuate shape;

said propeller urging fluid upwardly toward said buoy when said motor is turned on to rotate said propeller, said propeller being completely exposed around its lateral periphery; and a positioning cable being attached to said fluid movement assembly to facilitate movement of said fluid movement assembly within the fluid holding structure.

14. A circulator system configured to be positioned within a fluid holding structure and to circulate fluid within the fluid holding structure, said system comprising:

a fluid movement assembly configured to urge fluid upwardly towards a surface of the fluid holding structure, said fluid movement assembly including:

a propeller including a housing having a perimeter wall with an upper edge and a lower edge, a plurality of blades being attached to an outer surface of said perimeter wall;

a motor being mechanically coupled to said propeller and being positioned above said propeller;

a housing having a bottom edge, a motor being mounted in said housing adjacent to said bottom edge;

said propeller urging fluid upwardly toward said housing when said motor is turned on to rotate said propeller, said propeller being completely exposed around its lateral periphery; and a positioning cable being attached to said fluid movement assembly to facilitate movement of said fluid movement assembly within the fluid holding structure.

15. The circulator system according to claim 14, wherein said fluid movement assembly further includes:

a stand configured to abut a floor of a fluid holding structure;

a deflector being attached to said stand such that said stand is positioned beneath said deflector, said deflector having a convexly shaped outer surface facing said stand, said deflector being attached to an upper section of said stand opposite of said lower section; and said propeller being attached to an upwardly facing side of said deflector.

16. The circulator system according to claim 14, wherein said bottom edge of said housing is covered by a shroud extending from said propeller to prevent material from flowing laterally between said bottom edge and said propeller.

17. The circulator system according to claim 16, wherein said shroud is formed by an upwardly extending flange attached to said housing of said propeller.

18. The circulator system according to claim 16, wherein said shroud is formed by a sleeve positioned within said housing of said propeller and extending upwardly therefrom, said bottom edge being positioned within said sleeve.

19. The circulator system according to claim 14, wherein each of said blades is shaped such that each blade is contoured upwardly along a peripheral surface of said housing, said blades each having a distal ends with respect to said housing, a plane extending through each of said distal ends is positioned above said bottom edge of said housing.

20. The circulator system according to claim 19, wherein said housing includes an upper end and a peripheral surface extending between said upper end and said bottom edge, said peripheral surface including a lowermost portion including said bottom edge, an uppermost portion including said upper end and a medial portion positioned between said lowermost and said uppermost portions, said medial portion having a convexly arcuate shape, wherein said blades are contoured along at least a portion of said medial portion.

21. The circulator system according to claim 16, wherein each of said blades is shaped such that each blade is contoured upwardly along a peripheral surface of said housing, said blades each having a distal ends with respect to said housing, a plane extending through each of said distal ends is positioned above said bottom edge of said housing.

22. The circulator system according to claim 21, wherein said housing includes an upper end and a peripheral surface extending between said upper end and said bottom edge, said peripheral surface including a lowermost portion including said bottom edge, an uppermost portion including said upper end and a medial portion positioned between said lowermost and said uppermost portions, said medial portion having a convexly arcuate shape, wherein said blades are contoured along at least a portion of said medial portion.

* * * * *